US007921620B2

(12) United States Patent
Cashman

(10) Patent No.: US 7,921,620 B2
(45) Date of Patent: Apr. 12, 2011

(54) METHOD OF FRAMING A WALL PENETRATION

(76) Inventor: Daniel J. Cashman, Suffield, CT (US)

( * ) Notice: Subject to any disclaimer, the term of this patent is extended or adjusted under 35 U.S.C. 154(b) by 0 days.

(21) Appl. No.: 12/925,472

(22) Filed: Oct. 22, 2010

(65) Prior Publication Data

US 2011/0041453 A1 Feb. 24, 2011

Related U.S. Application Data

(62) Division of application No. 12/152,112, filed on May 12, 2008, now Pat. No. 7,874,108.

(51) Int. Cl.
*E06B 1/00* (2006.01)
*E04B 1/00* (2006.01)

(52) U.S. Cl. ..... 52/745.16; 52/745.15; 52/204.1; 52/204.596; 52/204.71; 52/204.72; 52/745.2; 52/745.19

(58) Field of Classification Search ..... 52/745.19, 52/745.2, 745.15, 745.16, 745.05, 204.1, 52/210, 212, 213, 208, 204.53, 214, 204.54, 52/204.55, 204.595, 204.68, 204.7, 204.71, 52/204.72
See application file for complete search history.

(56) References Cited

U.S. PATENT DOCUMENTS

| | | | | | |
|---|---|---|---|---|---|
| 2,197,913 | A | | 4/1940 | Axe | 52/204.595 |
| 2,378,163 | A | | 6/1945 | Thomas | 160/40 |
| 2,976,583 | A | * | 3/1961 | McCarthy | 52/402 |
| 3,214,873 | A | | 11/1965 | Davis | 52/513 |
| 3,499,248 | A | | 3/1970 | Baer | 49/430 |
| 4,027,431 | A | | 6/1977 | Rackard | 49/458 |
| 4,222,200 | A | | 9/1980 | Beirnes | 49/63 |
| 4,275,526 | A | | 6/1981 | Abramson | 49/501 |
| 4,488,391 | A | * | 12/1984 | Pavnica | 52/745.16 |
| 4,624,091 | A | | 11/1986 | Biro | 52/656.5 |
| 4,875,271 | A | * | 10/1989 | Coller et al. | 29/432 |
| 5,123,211 | A | * | 6/1992 | Schlicht et al. | 52/202 |
| 5,444,947 | A | * | 8/1995 | Miller | 52/100 |
| 5,623,796 | A | * | 4/1997 | McCabe | 52/220.8 |
| 5,768,839 | A | | 6/1998 | McCabe | 52/220.8 |
| 6,141,922 | A | * | 11/2000 | Carlisle et al. | 52/204.1 |
| 6,151,849 | A | * | 11/2000 | Twigg et al. | 52/208 |
| 6,272,799 | B1 | * | 8/2001 | Ashelin et al. | 52/173.2 |
| 6,427,398 | B1 | * | 8/2002 | Levine et al. | 52/204.56 |
| 7,107,736 | B2 | * | 11/2009 | Eschenburg | 269/10 |

(Continued)

FOREIGN PATENT DOCUMENTS

| | | | | | |
|---|---|---|---|---|---|
| GB | 2275061 | A | * | 8/1994 | 52/745.16 |

*Primary Examiner* — Jeanette E. Chapman
(74) *Attorney, Agent, or Firm* — Alix, Yale & Ristas, LLP

(57) ABSTRACT

A method of affixing a frame around a wall penetration such as a window box before siding panels are affixed to the wall. The frame has front and back faces and inner and outer edges, a primary channel extending along the outer edge, and a flange extending along the outer edge, The steps include: placing the window frame around the window box; affixing the flange to the wall; placing a first panel against the wall and inserting a vertical edge of the first panel into a primary channel of the frame; affixing the first panel to the wall; inserting a vertical edge of a second panel into the primary channel and engaging a longitudinal edge of the second panel with a longitudinal edge of the first panel; affixing the second panel to the wall; and repeating steps until the all sides of the frame engage siding panels.

8 Claims, 3 Drawing Sheets

U.S. PATENT DOCUMENTS

| | | | | |
|---|---|---|---|---|
| 7,290,379 | B2 * | 2/2010 | Gaus | 52/204.5 |
| 7,587,868 | B2 * | 3/2010 | Conlin | 52/745.16 |
| 7,721,499 | B2 * | 5/2010 | Lynch et al. | 52/455 |
| 2002/0046532 | A1 * | 4/2002 | Rochman | 52/656.4 |
| 2002/0189196 | A1 | 12/2002 | Homung et al. | 52/786.13 |
| 2004/0154244 | A1 * | 8/2004 | Moffatt | 52/204.55 |
| 2009/0266014 | A1 * | 10/2009 | Green | 52/204.55 |
| 2010/0011682 | A1 * | 1/2010 | Lundsgaard et al. | 52/200 |
| 2010/0064607 | A1 * | 3/2010 | Warunek | 52/213 |
| 2010/0077681 | A1 * | 4/2010 | McCleskey | 52/220.1 |
| 2010/0154329 | A1 * | 6/2010 | Adkins et al. | 52/204.1 |
| 2010/0170186 | A1 * | 7/2010 | Hohmann, Jr. | 52/741.4 |
| 2010/0251635 | A1 * | 10/2010 | Barnard et al. | 52/127.6 |
| 2010/0269432 | A1 * | 10/2010 | Furgerson et al. | 52/213 |
| 2010/0287855 | A1 * | 11/2010 | Stephens | 52/204.55 |

* cited by examiner

METHOD OF FRAMING A WALL PENETRATION

RELATED APPLICATION

This application is a divisional and claims benefit under 35 U.S.C. §120 of U.S. application Ser. No. 12/152,112 filed May 12, 2008 now U.S. Pat. No. 7,874,108, for "Window Frame with Installation Flange".

BACKGROUND

The present invention relates to building construction and in particular to the framing of doors, windows, and other wall penetrations.

Many residential and some commercial buildings have a clapboard type siding of wood, aluminum, or vinyl, during construction or renovation, that must be trimmed to accommodate a wall penetration where a window box or the like is to be mounted.

Typically, a frame is secured to the wall and surrounds the window box, to provide both a visual enhancement to the window as well as an interface for a clean transition with the siding that surrounds the wall penetration.

SUMMARY

The object of the present invention is to provide a window frame or similar building component which can be attached to a wall surrounding a wall penetration, before siding or the like is secured to the wall, in a manner that does not require driving attachment hardware through the front face of the frame.

In a general aspect, the invention is directed to a window frame comprising a frame body defining a closed perimeter, the body having front and back faces and inner and outer edges with the outer edges defining a frame perimeter. A channel extends along the outer edge of the frame body and mounting strips are located in the channel, thereby providing a mounting flange around the perimeter of the frame.

The frame has a channel closer to the back face, having a thickness less than the thickness of the siding, for accommodating the flange.

For use with vinyl siding, primary and secondary channels are provided around the periphery of the frame, whereby the side edges of siding elements can be slid laterally into the primary channel and strips of plastic or the like can be secured within the secondary channels. The strips form the flange which is securable to the wall, and thereafter the siding elements can be inserted into the primary channels to finish the installation.

In this aspect, the invention is directed to a window frame comprising top, bottom and opposed side frame elements connected together to define a rectangular frame, each element having front and back faces and inner and outer edges whereby the outer edges define the frame perimeter. A primary channel extends along the outer edges of at least the side elements, and a secondary channel extends along the outer edges of at least the side elements, respectively between the primary channel and the back face.

In a related aspect, the window frame further includes a mounting strip having an inner edge extending through the secondary channel of each element and an outer edge outside the perimeter of the frame, thereby forming a flange, preferably with holes for receiving mounting nails or the like.

In yet another aspect, the invention is directed to a method of affixing a window frame around a window penetration or box in a flat wall before siding panels are affixed to the wall. The method comprises selecting a frame of the type having a channel for the mounting strips. The frame could have the strips already secured therein forming the mounting flange around the periphery of the frame, or the installer would insert the strips into the channel to form the flange. The frame with flange is placed around the window box with the back face of the frame against the wall. The flange is then affixed to the wall. Wood siding elements are cut to fit tight against the edge of the frame. For other than wood siding, the frame has another, wider channel toward the front such that a first siding panel is placed against the wall and a vertical edge is inserted into the front channel of the frame. Subsequent siding panels are similarly slid along the wall into the larger channel.

In this manner, a partially or totally prefabricated frame can be secured to the wall surrounding the wall penetration without attaching or driving any hardware into or on the frame itself.

DETAILED DESCRIPTION

Figure 1:
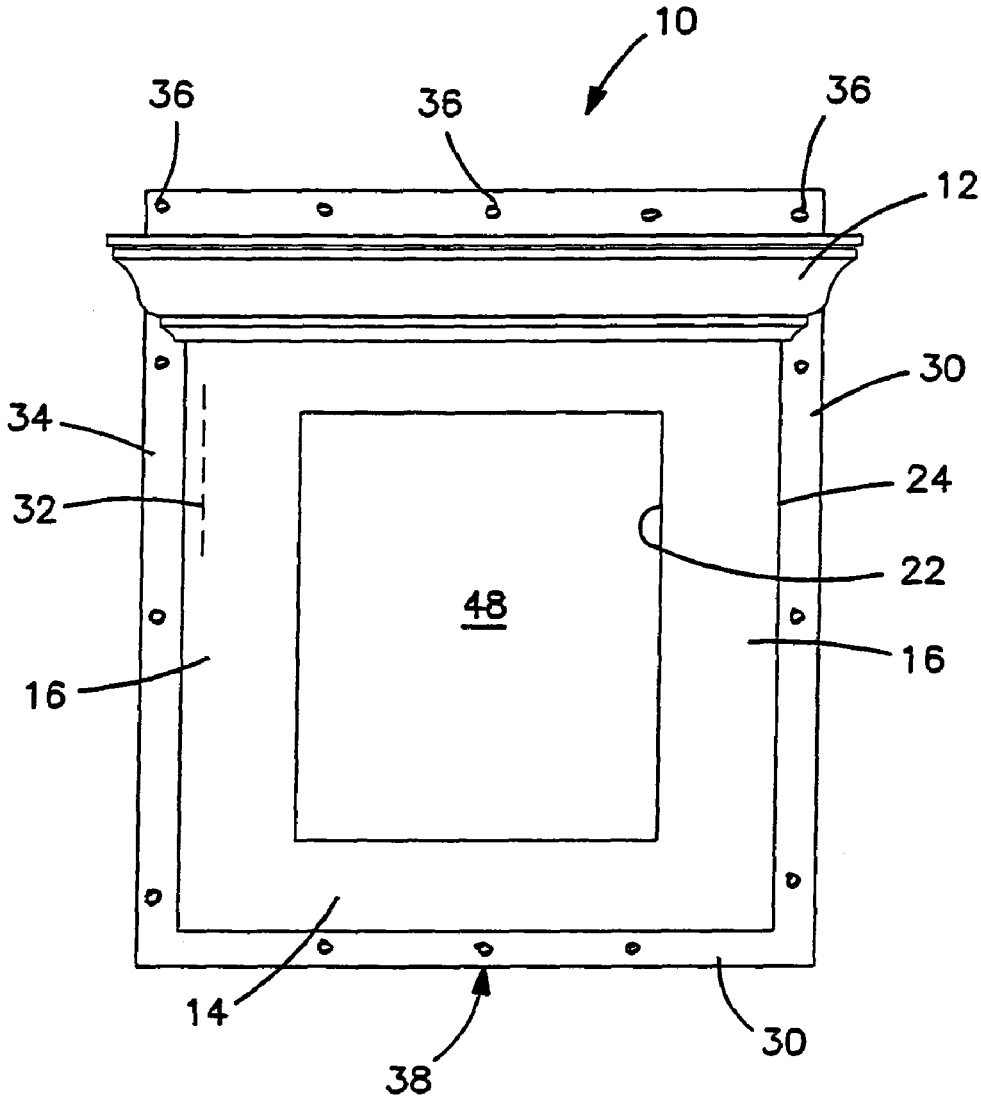
FIG. 1 is a front view of a window frame placed over a wall penetration prior to attachment of the frame to the wall.
Figure 2:
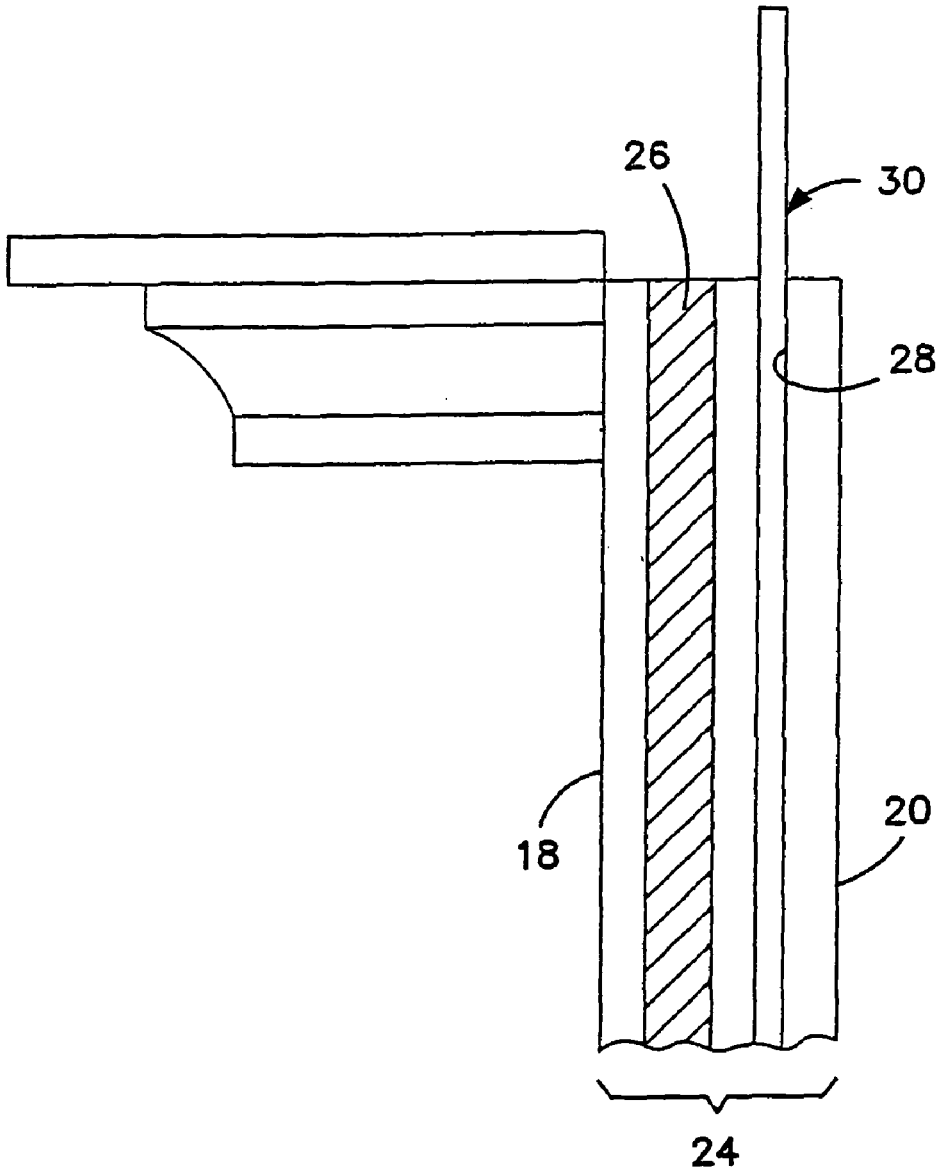
FIG. 2 is a side elevation view of the upper portion of the window frame of FIG. 1 showing the primary channel for receiving the edges of siding panels and a elongated strip in a secondary channel, forming a portion of the mounting flange for the frame.

FIGS. 1 and 2 show a prefabricated window frame 10 especially adapted for use with vinyl wall siding, having a top element 12, a bottom element 14, and side elements 16 connected together to define a rectangular frame, each element having front 18 and back 20 faces, and inner 22 and outer 24 edges, whereby the outer edges define the frame perimeter. At least the side elements 16, 18, and preferably all the elements have a primary channel 26 extending along the outer edge, and a secondary channel 28 extending along the outer edge between the primary channel 26 and the back face 20. Preferably, but not necessarily, the primary channel is situated closer to the front face 18, than to the secondary channel 28.

In the fully prefabricated embodiment shown in FIG. 1, a mounting strip 30 having an inner edge 32 (shown in phantom) extends through the secondary channel of each element, and an outer edge 34 outside the perimeter of the frame. Each mounting strip preferably includes a plurality of holes 36 for receiving mounting hardware such as nails or screws driven into the wall surrounding the wall penetration to be outlined by the wall penetration or window box to be surrounded by the frame. Preferably, the mounting strips are plastic and have a thickness which requires some degree of compression when slid into the secondary channels, producing an interference fit. Alternatively, mounting brackets or similar structures (not shown) can be located in the channels for positive engagement of the strips. In the preferred embodiment shown in FIG. 1, the strips form a flange surrounding the window box or penetration in the wall.

Preferably, the primary channel 26 is wider than the secondary channel 28, because the thickness of the flange 30 is typically about 1/16 inch, whereas the butt end of the siding elements or panels to be received in the primary channel 26, is wider and needs to be accommodated in a channel that is about ¾ inch. The primary channel should be slightly wider than the butt of vinyl siding to allow for expansion. If used for wood siding, the primary channel can be eliminated, because the wood siding would typically be cut tight and caulked. The strip mounting channel would be less than about ⅛ inch in width, closer to the back face of the frame.

Figure 3:
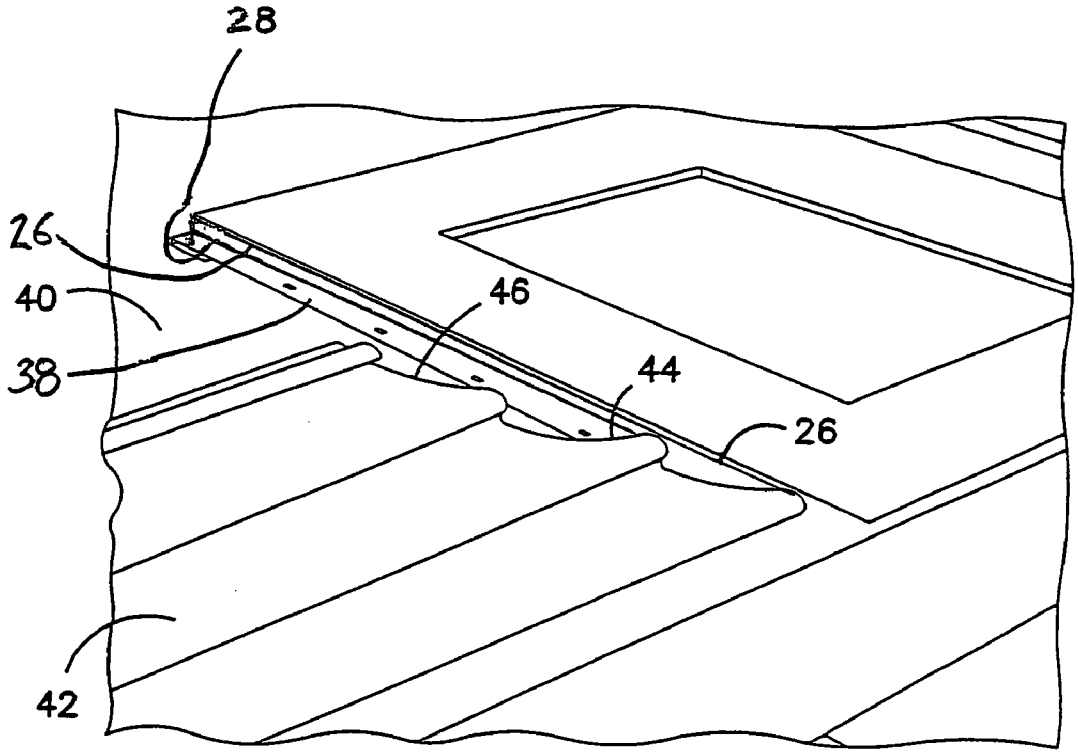
FIG. 3 is an oblique view if the frame with flange during the process of inserting the end edges of the siding panels into the primary channel of one side element of the frame.

With reference also the FIG. 3, the method of installation for use with vinyl siding will be described in greater detail. The frame can either be prefabricated with the flange as shown in FIG. 1, or the frame can be shipped to the installation site with the strips as separate components. Whether prefabricated as an entire unit, or assembled on site as such unit, the frame with strips and/or complete flange 38 are placed around the window box or similar penetration with the back face 20 of the frame against the wall 40. The flange is then affixed to the wall, such as by nailing through holes 36 to arrive at the condition shown in FIG. 1. To accommodate the subsequent attachment of the siding 42 to the wall 40, the longitudinal and seams 44 and end edges 46 of the panels are slid into the primary channel 26 of each frame element.

Thus, after the frame has been affixed to the wall, a first panel is placed against the wall and inserted with either a longitudinal edge at the seam 44, or an end edge 46, into a primary channel. Typically, the first side panel would be at the bottom 14 of the frame with a longitudinal seam inserted within the longitudinal channel associated with the bottom element. Subsequent panel elements would be connected to each other in vertical sequence and likewise the end seams and edges including ends of the seams would be inserted into the primary channel of the side element 16 of the frame. This process would continue with subsequent end edges 44 or 46 until the top 12 of the frame is reached, where upon another longitudinal seam 44 may or may not be inserted into the corresponding primary channel in the top element, depending on the spacing of the seams and the size and location of the frame relative to the initial panel inserted in the bottom element 14.

The invention is also usable with wood siding, but as discussed above, only one channel, for the flange strips, is required.

What is claimed is:

1. A method of affixing a window frame around a window box in a flat wall before siding panels are affixed to the wall, comprising:

(a) selecting a window frame having a frame body defining a closed perimeter for the window box, the body having front and back faces and inner and outer edges, a primary channel extending along the outer edge of the frame body, and a flange extending along the outer edge of the frame body, between the primary channel and the back face;

(b) placing the window frame around the window box, with the back face of the frame against the wall;

(c) affixing the flange to the wall;

(d) placing a first panel against the wall and inserting a vertical edge of the first panel into a primary channel of the frame;

(e) affixing the first panel to the wall;

(f) selecting a second panel and inserting a vertical edge of the second panel into the primary channel of the frame and engaging a longitudinal edge of the second panel with a longitudinal edge of the first panel;

(g) affixing the second panel to the wall; and (h) repeating steps (d) through (g) multiple times.

2. The method of claim 1, including (i) inserting a longitudinal edge of at least one other panel into a primary channel before affixing the other panel to the wall.

3. A method of affixing a frame around a wall penetration before siding panels are affixed to the wall, comprising the steps of:

(a) selecting a frame having front and back faces, an inner edge and an outer periphery, a flange extending laterally from the outer periphery, and an open channel extending along the outer periphery;

(b) placing the frame around the wall penetration, with the back face of the frame and the flange against the wall;

(c) affixing the flange to the wall;

(d) placing a first siding panel against the wall and inserting a vertical edge of the first panel into an open channel;

(e) affixing the first panel to the wall;

(f) selecting a second panel and inserting a vertical edge of the second panel into the same open channel and mating a horizontal edge of the second panel with a horizontal edge of the first panel;

(g) affixing the second panel to the wall; and (h) repeating steps (d) through (g) multiple times.

4. The method of claim 3, wherein the frame has a horizontal top element and opposed vertical side elements, each element having an inner edge and an outer periphery, a flange extending laterally from the outer periphery, and an open channel extending along the outer periphery; and steps (b) and (c) include placing the flange of each element against the wall and affixing each flange to the wall;

steps (d) through (h) are performed for each side element;

additional step (i) includes inserting a horizontal edge of a top siding panel into the open channel of the top element and affixing the top panel to the wall.

5. The method of claim 4, wherein the wall penetration is a doorway, the top and side elements are connected together, and step (b) includes placing the frame around a door in the doorway.

6. The method of claim 4, wherein the frame has a horizontal bottom element having an inner edge and an outer periphery, a flange extending laterally from the outer periphery, and an open channel extending along the outer periphery; and additional step (j) includes inserting a horizontal edge of a bottom siding panel into the open channel of the bottom element.

7. The method of claim 6, wherein a window box is situated in the wall penetration, and step (b) includes placing the frame around the window box.

8. The method of claim 7, wherein the window box is rectangular and the top, side, and bottom elements are connected together to form a unitary rectangular frame before the frame is placed around the wall penetration.

* * * * *